US008994272B2

(12) United States Patent
Horsky et al.

(10) Patent No.: US 8,994,272 B2
(45) Date of Patent: Mar. 31, 2015

(54) ION SOURCE HAVING AT LEAST ONE ELECTRON GUN COMPRISING A GAS INLET AND A PLASMA REGION DEFINED BY AN ANODE AND A GROUND ELEMENT THEREOF

(71) Applicant: Nissin Ion Equipment Co., Ltd., Minami-Ku, Kyoto (JP)

(72) Inventors: Thomas N. Horsky, Boxborough, MA (US); Sami K. Hahto, Nashua, NH (US)

(73) Assignee: Nissin Ion Equipment Co., Ltd., Minami-Ku, Kyoto (JP)

( * ) Notice: Subject to any disclaimer, the term of this patent is extended or adjusted under 35 U.S.C. 154(b) by 85 days.

(21) Appl. No.: 13/835,441

(22) Filed: Mar. 15, 2013

(65) Prior Publication Data

US 2014/0265854 A1 Sep. 18, 2014

(51) Int. Cl.
*H01J 7/24* (2006.01)
*H01J 27/20* (2006.01)

(52) U.S. Cl.
CPC ..... *H01J 27/205* (2013.01)
USPC ..... 315/111.81; 250/423 R

(58) Field of Classification Search
USPC ..... 315/111.11, 111.21, 111.31, 111.81; 250/423 R
See application file for complete search history.

(56) References Cited

U.S. PATENT DOCUMENTS

| | | | | |
|---|---|---|---|---|
| 5,311,028 | A | 5/1994 | Glavish | |
| 5,497,006 | A | 3/1996 | Sferlazzo et al. | |
| 5,703,372 | A | 12/1997 | Horsky et al. | |
| 5,834,786 | A | 11/1998 | White et al. | |
| 6,259,210 | B1 | 7/2001 | Wells | |
| 6,664,547 | B2 | 12/2003 | Benveniste | |
| 6,686,595 | B2 | 2/2004 | Horsky | |
| 6,744,214 | B2 | 6/2004 | Horsky | |
| 6,777,686 | B2 | 8/2004 | Olson et al. | |
| 7,064,491 | B2 | 6/2006 | Horsky et al. | |
| 7,185,602 | B2 | 3/2007 | Horsky et al. | |
| 7,622,713 | B2 * | 11/2009 | Quarmby et al. | 250/288 |
| 7,718,041 | B2 | 5/2010 | Menger et al. | |
| 7,759,657 | B2 | 7/2010 | Tieger et al. | |
| 7,791,041 | B2 | 9/2010 | Yamashita et al. | |
| 7,838,850 | B2 * | 11/2010 | Hahto et al. | 250/492.21 |
| 7,989,784 | B2 | 8/2011 | Glavish et al. | |

(Continued)

FOREIGN PATENT DOCUMENTS

| | | |
|---|---|---|
| EP | 1 180 783 A2 | 2/2002 |
| JP | 2007-220522 | 8/2007 |

(Continued)

OTHER PUBLICATIONS

Ikejiri, et al., "Beam Uniformity Controllable Ion Source with a Long Slit," Ion Implantation Technology, 2008, 4 pages.

*Primary Examiner* — Thuy Vinh Tran
(74) *Attorney, Agent, or Firm* — Proskauer Rose LLP

(57) ABSTRACT

An ion source is provided that includes at least one electron gun. The electron gun includes an electron source for generating a beam of electrons and an inlet for receiving a gas. The electron gun also includes a plasma region defined by at least an anode and a ground element, where the plasma region can form a plasma from the gas received via the inlet. The plasma can be sustained by at least a portion of the beam of electrons. The electron gun further includes an outlet for delivering at least one of (i) ions generated by the plasma or (ii) at least a portion of the beam of electrons generated by the electron source.

23 Claims, 9 Drawing Sheets

(56) References Cited

U.S. PATENT DOCUMENTS

| | | | |
|---|---|---|---|
| 8,072,149 | B2 | 12/2011 | Cho et al. |
| 8,110,820 | B2 | 2/2012 | Glavish et al. |
| 8,193,513 | B2 | 6/2012 | DiVergilio et al. |
| 8,357,912 | B2 | 1/2013 | Radovanov et al. |
| 8,436,326 | B2 | 5/2013 | Glavish et al. |
| 2004/0104683 | A1 | 6/2004 | Leung et al. |
| 2006/0019039 | A1 | 1/2006 | Hanawa et al. |
| 2006/0284104 | A1 | 12/2006 | Fujita et al. |
| 2007/0089833 | A1 | 4/2007 | Inouchi et al. |
| 2008/0277593 | A1 | 11/2008 | Fujita et al. |
| 2008/0290266 | A1 | 11/2008 | Horsky et al. |
| 2009/0014667 | A1 | 1/2009 | Hahto et al. |
| 2009/0206270 | A1 | 8/2009 | Glayish et al. |
| 2010/0025573 | A1 | 2/2010 | Hahto et al. |
| 2010/0066252 | A1 | 3/2010 | Reijonen et al. |
| 2010/0107980 | A1 | 5/2010 | Horsky et al. |
| 2010/0320395 | A1 | 12/2010 | Hahto et al. |
| 2011/0084219 | A1* | 4/2011 | Adamec et al. ..... 250/492.1 |
| 2011/0089321 | A1 | 4/2011 | Glavish et al. |
| 2011/0139613 | A1 | 6/2011 | Ikejiri et al. |
| 2012/0255490 | A1 | 10/2012 | Tanjo |

FOREIGN PATENT DOCUMENTS

| | | |
|---|---|---|
| JP | 2008-034230 | 2/2008 |
| JP | 2008-047491 | 2/2008 |
| JP | 2008-084679 | 4/2008 |
| JP | 2008-097975 | 4/2008 |
| WO | 02/25685 A1 | 3/2002 |

* cited by examiner

ION SOURCE HAVING AT LEAST ONE ELECTRON GUN COMPRISING A GAS INLET AND A PLASMA REGION DEFINED BY AN ANODE AND A GROUND ELEMENT THEREOF

FIELD OF THE INVENTION

The invention relates generally to ion sources, and more particularly, to ion sources adapted to generate an ion beam having a relatively uniform ion density distribution along a longitudinal axis of an ionization chamber.

BACKGROUND OF THE INVENTION

Ion implantation has been a critical technology in semiconductor device manufacturing and is currently used for many processes including fabrication of the p-n junctions in transistors, particularly for CMOS devices such as memory and logic chips. By creating positively-charged ions containing the dopant elements required for fabricating the transistors in silicon substrates, the ion implanters can selectively control both the energy (hence implantation depth) and ion current (hence dose) introduced into the transistor structures. Traditionally, ion implanters have used ion sources that generate a ribbon beam of up to about 50 mm in length. The beam is transported to the substrate and the required dose and dose uniformity are accomplished by electromagnetic scanning of the ribbon across the substrate, mechanical scanning of the substrate across the beam, or both. In some cases, an initial ribbon beam can be expanded to an elongated ribbon beam by dispersing it along a longitudinal axis. In some cases, a beam can even assume an elliptical or round profile.

Currently, there is an interest in the industry in extending the design of conventional ion implanters to produce a ribbon beam of larger extent. This industry interest in extended ribbon beam implantation is generated by the recent industry-wide move to larger substrates, such as 450 mm-diameter silicon wafers. During implantation, a substrate can be scanned across an extended ribbon beam while the beam remains stationary. An extended ribbon beam enables higher dose rates because the resulting higher ion current can be transported through the implanter beam line due to reduced space charge blowup of the extended ribbon beam. To achieve uniformity in the dose implanted across the substrate, the ion density in the ribbon beam needs to be fairly uniform relative to a longitudinal axis extending along its long dimension. However, such uniformity is difficult to achieve in practice.

In some beam implanters, corrector optics have been incorporated into the beam line to alter the ion density profile of the ion beam during beam transport. For example, Bernas-type ion sources have been used to produce an ion beam of between 50 mm to 100 mm long, which is then expanded to the desired ribbon dimension and collimated by ion optics to produce a beam longer than the substrate to be implanted. Using corrector optics is generally not sufficient to create good beam uniformity if the beam is greatly non-uniform upon extraction from the ion source or if aberrations are induced by space-charge loading and/or beam transport optics.

In some beam implanter designs, a large-volume ion source is used that includes multiple cathodes aligned along the longitudinal axis of the arc slit, such that emission from each cathode can be adjusted to modify the ion density profile within the ion source. Multiple gas introduction lines are distributed along the long axis of the source to promote better uniformity of the ion density profile. These features attempt to produce a uniform profile during beam extraction while limiting the use of beam profile-correcting optics. Notwithstanding these efforts, the problem of establishing a uniform ion density profile in the extracted ion beam remains one of great concern to manufacturers of ribbon beam ion implanters, especially when utilizing ion sources having extraction apertures dimensioned in excess of 100 mm. Therefore, there is a need for an improved ion source design capable of producing a relatively uniform extracted ion beam profile.

SUMMARY OF THE INVENTION

The present invention provides an improved ion source capable of generating a ribbon beam with a uniform ion density profile and is of sufficient extent to implant a substrate substantially along its length, such as a 300-mm or 450-mm substrate. In some embodiments, an extended ribbon beam, such as a 450-mm ribbon beam, is generated by the ion source of the present invention, which is then transported through an ion implanter while the beam dimensions are substantially preserved during transport. The substrate can be scanned across the stationary ribbon beam with a slow horizontal mechanical scan.

In one aspect, an ion source is provided that includes at least one electron gun. The electron gun includes an electron source for generating a beam of electrons, an inlet for receiving a gas, a plasma region, and an outlet. The plasma region is defined by at least an anode and a ground element. The plasma region is adapted to form a plasma from the gas received via the inlet, and the plasma is sustained by at least a portion of the beam of electrons generated by the electron source. The outlet is configured to deliver at least one of (i) ions generated by the plasma or (ii) at least a portion of the beam of electrons generated by the electron source.

In another aspect, an ion source is provided that includes an ionization chamber and two electron guns. The ionization chamber includes i) two internal apertures at two opposite ends along a longitudinal axis extending through the ionization chamber and ii) an exit aperture along a side wall of the ionization chamber for extracting ions from the ionization chamber. The two electron guns are each positioned relative to one of the two internal apertures. Each electron gun includes an electron source for generating a beam of electrons, an inlet for receiving a gas from the ionization chamber, and a plasma region for generating a plasma from the gas. The plasma region is sustained by at least a portion of the beam of electrons generated by the electron source. Each electron gun delivers to the ionization chamber at least one of (i) ions formed by the plasma of the corresponding electron gun or (ii) at least a portion of the beam of electrons generated by the corresponding electron gun.

In yet another aspect, a method for operating an ion source is provided. The method includes generating a beam of electrons by an electron source of an electron gun, receiving a gas at an inlet of the electron gun, forming a plasma in a plasma region of the electron gun from the gas and the beam of electrons, and providing at least one of (i) ions formed by the plasma or (ii) at least a portion of the beam of electrons via an outlet of the electron gun to an ionization chamber.

In yet another aspect, an electron gun is provided. The electron gun includes an electron source for generating a beam of electrons, an inlet for receiving a gas, a plasma region and an outlet. The plasma region is defined by at least an anode and a ground element. The plasma region is adapted to form a plasma of the gas received, and the plasma is sustained by at least a portion of the beam of electrons generated by the electron source. The outlet is configured to deliver at least one of (i) ions formed by the plasma or (ii) at least a portion of the beam of electrons generated by the electron source.

In yet another aspect, an ion source is provided. The ion source includes a gas source for supplying a gas, at least one electron gun, an ionization chamber and a control circuit. The electron gun include an emitter for generating a beam of electrons and a plasma region defined by at least an anode and a ground element. The plasma region is adapted to form a secondary plasma from the gas that is sustained by at least a portion of the beam of electrons. The ionization chamber receives from the at least one electron gun at least one of (i) a first set of ions generated by the secondary plasma or (ii) at least a portion of the beam of electrons. The ionization chamber is adapted to form a primary plasma from the gas and the at least a portion of the beam of electrons and the primary plasma generates a second set of ions. The control circuit is configured for modulating at least one of a voltage of the anode or a voltage of the emitter to produce desired quantities of the first set of ions and the second set of ions. The first set of ions includes more dissociated ions than the second set of ions. In some embodiments, the control circuit is configured to operate in a monomer mode by producing more of the first set of ions than the second set of ions. In some embodiments, the control circuit is configured to operate in a cluster mode by producing more of the second set of ions than the first set of ions.

In other examples, any of the aspects above can include one or more of the following features. In some embodiments, the ion source further includes a control circuit for adjusting a voltage of the anode to substantially turn off the plasma in the plasma region. In such a situation, the outlet is configured to deliver the at least a portion of the beam of electrons generated by the electron source without the ions.

In some embodiments, the ground element comprises at least one lens for decelerating the at least a portion of the beam of electrons generated by the electron source prior to the beam of electrons leaving the at least one electron gun via the outlet.

In some embodiments, the inlet and the outlet of the at least one electron gun comprise a single aperture. The ion source includes an ionization chamber having two ends disposed along a longitudinal axis and one of the two ends is coupled to the aperture of the at least one electron gun. The aperture is configured to (i) supply the gas from the ionization chamber to the electron gun and (ii) receive at least one of the ions or the at least a portion of the beam of electrons from the electron gun to the ionization chamber.

In some embodiments, the ion source includes a second electron gun substantially similar to the at least one electron gun. Each electron gun is positioned at one of the two ends of the ionization chamber for delivering at least one of the ions or the beam of electrons to the ionization chamber.

In some embodiments, the ion source further comprises at least one extraction electrode at an exit aperture of the ionization chamber for extracting ions from the ionization chamber. The ionization chamber or the at least one extraction electrode, or a combination thereof, can be made of graphite. In some embodiments, the ion source further includes four extraction electrodes. At least two of the extraction electrodes are movable relative to the ionization chamber.

In some embodiments, the electron source of an electron gun includes: (i) a filament and (ii) a cathode indirectly heated by a current thermionically emitted by the filament to generate the beam of electrons. The ion source can include a first closed loop control circuit for adjusting the voltage across the filament to maintain the emission current of the filament to the cathode at or near a reference current value. The ion source can include a second closed loop control circuit for adjusting the potential between the filament and the cathode to maintain the current of the anode at or near a reference current value.

In some embodiments, the ionization chamber includes a plurality of gas inlets along a sidewall of the chamber for delivering a gas into the ionization chamber. The gas can be ionized by the at least a portion of the beam of electrons supplied by one or more electron guns.

Other aspects and advantages of the present invention will become apparent from the following detailed description, taken in conjunction with the accompanying drawings, illustrating the principles of the invention by way of example only.

BRIEF DESCRIPTION OF THE DRAWINGS

The advantages of the technology described above, together with further advantages, may be better understood by referring to the following description taken in conjunction with the accompanying drawings. The drawings are not necessarily to scale, emphasis instead generally being placed upon illustrating the principles of the technology.

DESCRIPTION OF THE INVENTION

Figure 1:
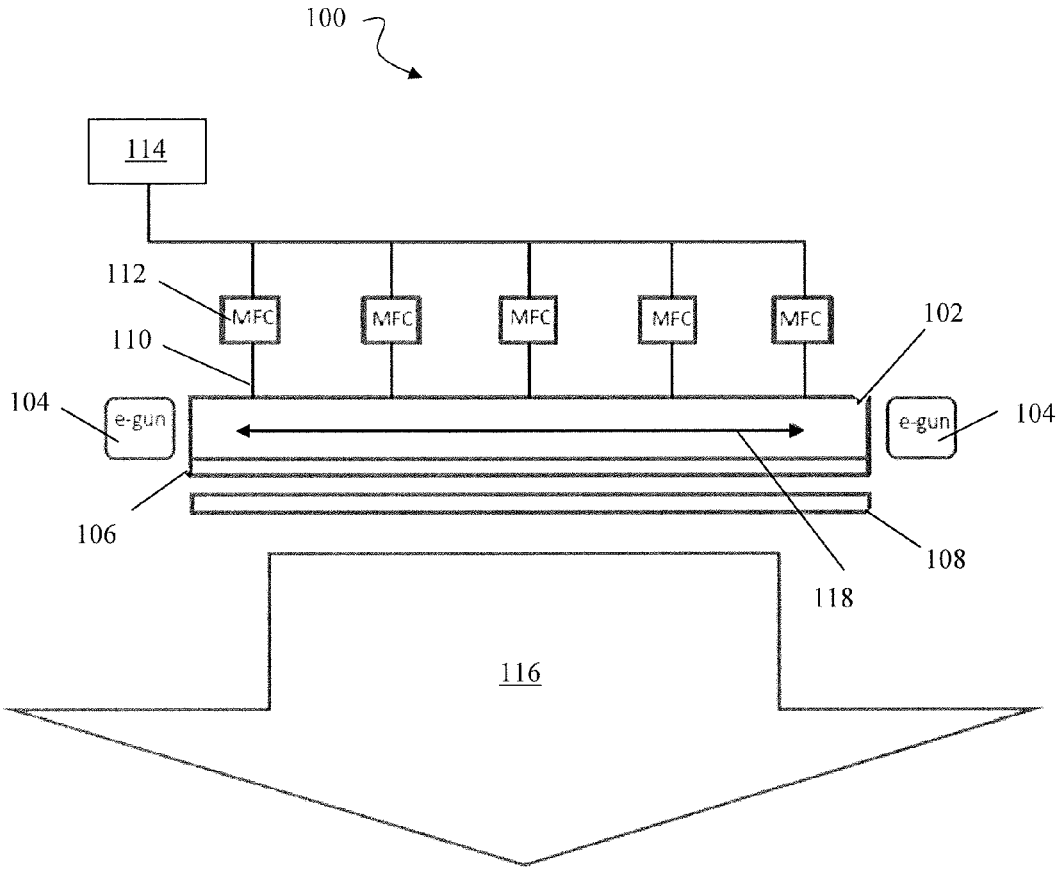
FIG. 1 shows a schematic diagram of an exemplary ion source, according to embodiments of the present invention.

FIG. 1 shows a schematic diagram of an exemplary ion source, according to embodiments of the present invention. The ion source 100 can be configured to produce an ion beam for transport to an ion implantation chamber that implants the ion beam into, for example, a semiconductor wafer. As shown, the ion source 100 includes an ionization chamber 102 defining a longitudinal axis 118 along the long dimension of the ionization chamber 102, a pair of electron guns 104, a plasma electrode 106, a puller electrode 108, a gas delivery system comprising a plurality of gas inlets 110 and a plurality of mass flow controllers (MFCs) 112, a gas source 114, and a resultant ion beam 116. In operation, gaseous material from the gas source 114 is introduced into the ionization chamber 102 via the gas inlets 110. The gas flow through each of the gas inlets 110 can be controlled by the respective mass flow controllers 112 coupled to the inlets 110. In the ionization chamber 102, a primary plasma forms from the gas molecules that are ionized by electron impact from the electron beam generated by each of the pair of electron guns 104 positioned on opposing sides of the ionization chamber 102. In some embodiments, the electron guns 104 can also introduce additional ions into the ionization chamber 102. The ions in the ionization chamber 102 can be extracted via an extraction aperture (not shown) and form an energetic ion beam 116 using an extraction system comprising the plasma electrode 106 and the puller electrode 108. The longitudinal axis 118 can be substantially perpendicular to the direction of propagation of the ion beam 116. In some embodiments, one or more magnetic field sources (not shown) can be positioned adjacent to the ionization chamber 102 and/or the electron guns 104 to produce an external magnetic field that confines the electron beam generated by the electron guns 104 inside of the electron guns 104 and the ionization chamber 102.

The gas source 114 can introduce one or more input gases into the ionization chamber 102, such as $AsH_3$, $PH_3$, $BF_3$, $SiF_4$, Xe, Ar, $N_2$, $GeF_4$, $CO_2$, CO, $CH_3$, $SbF_5$, and $CH_6$, for example. The input gas can enter the ionization chamber 102 via a gas delivery system including i) multiples gas inlets 110 spaced on a side wall of the ionization chamber 102 along the longitudinal axis 118, and ii) multiple mass flow controllers 112 each coupled to one of the gas inlets 110. Because the ion density of the primary plasma in the ionization chamber 102 depends on the density of the input gas, adjusting each mass flow controller 112 separately can provide improved control of ion density distribution in the longitudinal direction 118. For example, a control circuit (not shown) can monitor the ion density distribution of the extracted beam 116 and automatically adjust the flow rate of the input gas via one or more of the mass flow controllers 112 so as to achieve a more uniform density profile in the extracted beam 116 along the longitudinal direction. In some embodiments, the gas source 114 can include a vaporizer for vaporizing a solid feed material, such as $B_{10}H_{14}$, $B_{18}H_{22}$, $C_{14}H_{14}$, and/or $C_{16}H_{10}$, to generate a vapor input for supply into the ionization chamber 102. In this case, one or more separate vapor inlets (not shown) can be used to introduce the vapor input into the ionization chamber 102, bypassing the MFC-coupled inlets 110. The one or more separate vapor inlets can be dispersed evenly along a side wall of the ionization chamber 102 in the direction of the longitudinal axis 118. In some embodiments, the gas source 114 comprises one or more liquid phase gas sources. A liquid phase material can be gasified and introduced into the ionization chamber 102 using the gas delivery system comprising the gas inlets 110 and the mass flow controllers 112. The mass flow controllers 112 can be appropriated adjusted to facilitate the flow of the gas evolved from the liquid phase material.

In general, the ionization chamber 102 can have a rectangular shape that is longer in the longitudinal direction 118 than in the traverse direction (not shown). The ionization chamber 102 can also have other shapes, such as a cylindrical shape, for example. The length of the ionization chamber 102 along the longitudinal direction 118 may be about 450 mm. The extraction aperture (not shown) can be located on an elongated side of the ionization chamber 102 while each of the electron guns 102 is located at a transverse side. The extraction aperture can extend along the length of the ionization chamber 102, such as about 450 mm long.

To extract ions from the ionization chamber 102 and to determine the energy of the implanted ions, the ion source 100 is held at a high positive source voltage by a source power supply (not shown), between 1 kV and 80 kV, for example. The plasma electrode 106 can comprise an extraction aperture plate on a side of the ionization chamber 102 along the longitudinal axis 118. In some embodiments, the plasma electrode 106 is electrically isolated from the ionization chamber 102 so that a bias voltage can be applied to the plasma electrode 106. The bias voltage is adapted to affect characteristics of the plasma generated within the ionization chamber 102, such as plasma potential, residence time of the ions, and/or the relative diffusion properties of the ion species within the plasma. The length of the plasma electrode 106 can be substantially the same as the length of the ionization chamber 102. For example, the plasma electrode 106 can comprise a plate containing a 450 mm by 6 mm aperture shaped to allow ion extraction from the ionization chamber 102.

One or more additional electrodes, such as the puller electrode 108, are used to increase extraction efficiency and improve focusing of the ion beam 116. The puller electrode 108 can be similarly configured as the plasma electrode 106. These electrodes can be spaced from each other by an insulating material (e.g., 5 mm apart) and the electrodes can be held at different potentials. For example, the puller electrode 108 can be biased relative to the plasma electrode 106 or the source voltage by up to about −5 kV. However, the electrodes can be operated over a broad range of voltages to optimize performance in producing a desired ion beam for a particular implantation process.

Figure 2:
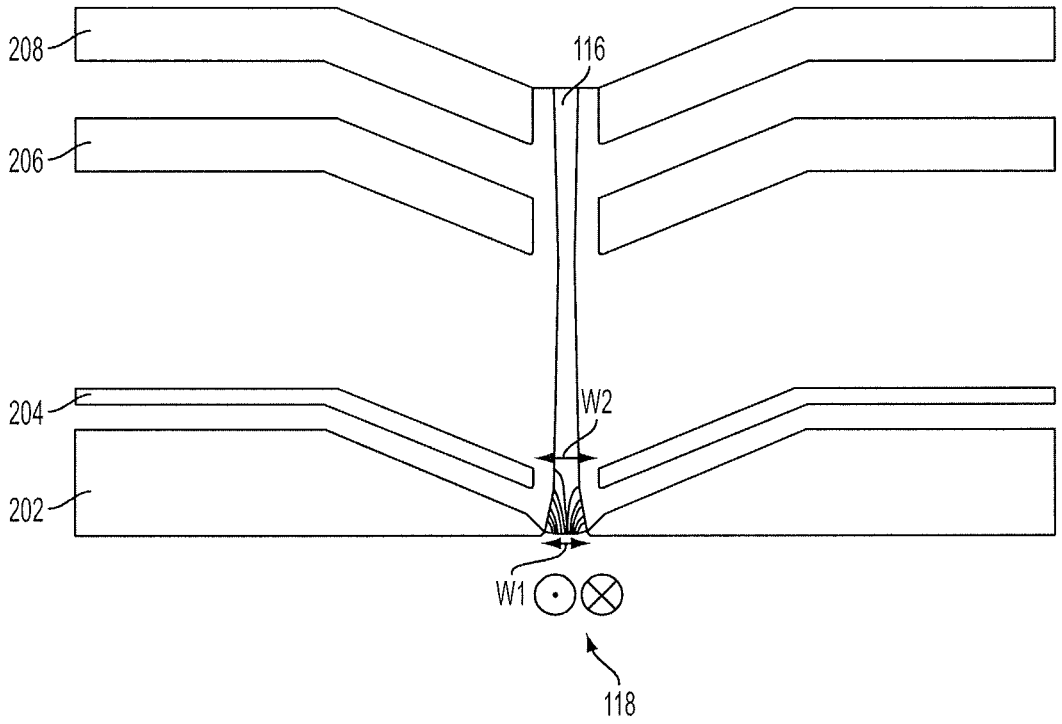
FIG. 2 shows a schematic diagram of an exemplary ion beam extraction system, according to embodiments of the present invention.

FIG. 2 shows a schematic diagram of an exemplary ion beam extraction system, according to embodiments of the present invention. As illustrated, the extraction system includes a plasma electrode 202 located closest to the ionization chamber 102, followed by a puller electrode 204, a suppression electrode 206 and a ground electrode 208. The electrode apertures are substantially parallel to the longitudinal axis 118 of the ionization chamber 102. The plasma electrode 202 and the puller electrode 204 are similar to the plasma electrode 106 and the puller electrode 108 of FIG. 1, respectively. In some embodiments, the plasma electrode 202 is shaped according to the Pierce angle to counteract the space charge expansion of the ion beam 116, thus enabling substantially parallel beam trajectories upon extraction. In some embodiments, the aperture of the plasma electrode 202 includes, on a side closest to the plasma in the ionization chamber 102, an undercut, which helps to define a plasma boundary by introducing a sharp edge (hereinafter referred to as a "knife edge.") The width of the plasma electrode aperture can be substantially the same as the width of the knife edge along the dispersive plane. This width is indicated as W1 in FIG. 2. The value of W1 can range from about 3 mm to about 12 mm. In addition, as shown in FIG. 2, the width of the aperture of the puller electrode 204 in the dispersive plane (W2) can be wider than that of the plasma electrode 202, such as about 1.5 times wider. The ground electrode 208 can be held at terminal potential, which is at earth ground unless it is desirable to float the terminal below ground, as is the case for certain implantation systems. The suppression electrode 206 is biased negatively with respect to the ground electrode 208, such as at about −3.5 kV, to reject or suppress unwanted electrons that otherwise would be attracted to the positively-biased ion source 100 when generating a positively-charged ion beam 116. In general, the extraction system is not limited to two electrodes (e.g., the suppression electrode 206 and the ground electrode 208); more electrodes can be added as needed.

In some embodiments, a control circuit (not shown) can automatically adjust the spacing of one or more of the electrodes along the direction of propagation of the ion beam 116 (i.e., perpendicular to the longitudinal axis 118) to enhance focusing of the ion beam 116. For example, a control circuit can monitor beam quality of the ion beam 116 and, based on the monitoring, move at least one of the suppression electrode 206 or the ground electrode 208 closer to or further away from each other to change the extraction field. In some embodiments, the control circuit tilts or rotates at least one of the suppression electrode 206 or the ground electrode 208 in relation to the path of the ion beam 116 to compensate for mechanical errors due to the placement of the electrodes. In some embodiments, the control circuit moves the suppression electrode 206 and the ground electrode 208 (group 1 electrodes) together along a particular beam path, in relation to the remaining electrodes (group 2 electrodes), including the plasma electrode 202 and the puller electrode 204, which can be held stationery. The gap between the group 1 electrodes and group 2 electrodes can be determined based on a number of factors, such as ion beam shape, required energy of the ion beam and/or ion mass.

Figure 3:
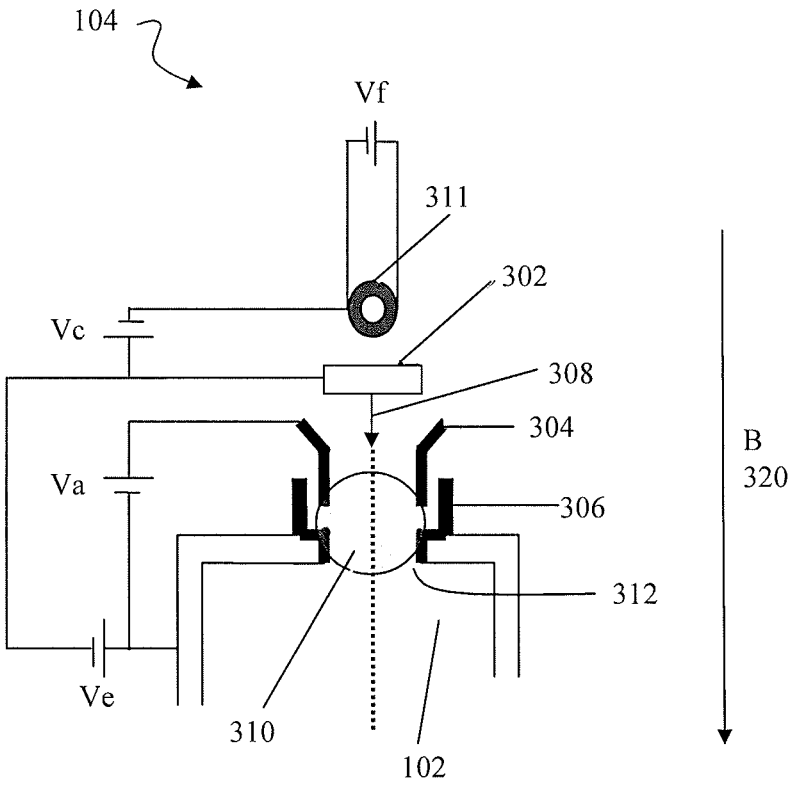
FIG. 3 shows a schematic diagram of an exemplary electron gun assembly, according to embodiments of the present invention.

FIG. 3 shows a schematic diagram of an exemplary electron gun assembly 104, according to embodiments of the present invention. As illustrated, the electron gun 104 includes a cathode 302, an anode 304, a ground element 306, and a control circuit (not shown). Thermionic electrons are emitted by the cathode 302, which may be constructed of refractory metal such as tungsten or tantalum, for example, and can be heated directly or indirectly. If the cathode 302 is heated indirectly, a filament 311 may be used to perform the indirect heating. Specifically, an electric current can flow through the filament 311 to heat the filament 311, which thermionically emits electrons as a result. By biasing the filament 311 to a voltage several hundred volts below the potential of the cathode 302, such as up to 600 V negative with respect to the cathode, the thermionically emitted electrons generated by the filament 311 can heat the cathode 302 by energetic electron bombardment. The cathode 302 is adapted to thermionically emit electrons, leading to the formation of an energetic electron beam 308 at the anode 304, which is held at a positive potential in relation to the cathode 302. The electron beam 308 is adapted to enter the ionization chamber 102 via aperture 312 of the ionization chamber, where it generates a primary plasma (not shown) by ionizing the gas within the ionization chamber 102.

In addition, the control circuit can cause a secondary plasma 310 to be formed in the electron gun 104 between the anode 304 and the ground element 306. Specifically, a potential can be created between the anode 304 and the ground element 306 such that it establishes an electric field sufficient to create the secondary plasma 310 in the presence of the electron beam 308. The secondary plasma is created by the ionization of a gas that enters the electron gun 104 from the ionization chamber 102 via the aperture 312, where the gas can be supplied by the inlets 110. The electron beam 308 can sustain the secondary plasma 310 for an extended period of time. The plasma density of the secondary plasma 310 is proportional to the arc current of the anode 304, which is an increasing function of the positive anode voltage. Therefore, the anode voltage can be used by the control circuit to control and stabilize the secondary plasma field 310 in conjunction with closed-loop control of the current sourced by an anode power supply (not shown). The secondary plasma 310 is adapted to generate positively charged ions that can be propelled into the ionization chamber 102 via the aperture 312, thereby increasing the ion density of the extracted ion beam 116. The propelling movement arises when the positively charged ions, generated by the secondary plasma 310, are repelled by the positively biased anode 304 to travel toward the ionization chamber 102.

The control circuit can form the secondary plasma 310 in the electron gun 104 by applying a positive voltage to the anode 304. The control circuit can control the amount of ions generated by the secondary plasma 310 and stabilize the secondary plasma 310 in part by closed-loop control of the current sourced by the anode power supply. This current is the arc current sustained by the plasma discharge between the anode 304 and the ground element 306. Hereinafter, this mode of operation is referred as the "ion pumping mode." In the ion pumping mode, in addition to ions, the electron beam 308 also travels to the ionization chamber 102 via the aperture 312 to form the primary plasma in the ionization chamber 102. The ion pumping mode may be advantageous in situations where increased extraction current is desired. Alternatively, the control circuit can substantially turn off the secondary plasma 310 in the electron gun 104 by suitably adjusting the voltage of the anode 304, such as setting the voltage of the anode 304 to zero. In this case, only the electron beam 308 flows from the electron gun 104 to the ionization chamber 102, without being accompanied by a significant quantity of positively charged ions. Hereinafter, this mode of operation is referred to as the "electron impact mode."

In yet another mode of operation, the control circuit can form the secondary plasma 310 in the electron gun 104 without providing the electron beam 308 to the ionization chamber 102. This can be accomplished by suitably adjusting the voltage of the emitter (i.e., the cathode 302), such as grounding the cathode 302 so it is at the same potential as the ionization chamber 102. The result is that the electrons in the electron beam 308 would have low energy as they enter the ionization chamber 102, effectively allowing much weaker or no electron beam to enter the ionization chamber 102 or form useful electron bombardment ionization within the ionization chamber 102. In this mode of operation, the secondary plasma 310 can generate positive ions for propulsion into the ionization chamber 102. In this mode of operation, the electron gun 104 acts as the plasma source, not the ionization chamber 102. Hereinafter, this mode of operation is referred to as the "plasma source mode." The plasma source mode has several advantages. For example, cost and complexity is reduced by removing the emitter voltage supply, which typically is a 2 kV, 1 A supply. The plasma source mode can be initiated in a plasma flood gun, a plasma doping apparatus, plasma chemical-vapor deposition (CVD), etc. In some embodiments, radio-frequency discharge can be used to generate the plasma 310 in the plasma source mode. However, in general, the electron gun 104 can act as a plasma source and/or an ion source.

Generally, activating the secondary plasma 310 in the electron gun 104 can prolong the usable life of the ion source 100. The primary limiting factor in achieving long ion source life is failure of the cathode 302, principally due to cathode erosion caused by ion sputtering. The degree of ion sputtering of the cathode 302 depends on a number of factors, including: i) the local plasma or ion density, and ii) the kinetic energy of the ions as they reach the cathode 302. Since the cathode 302 is remote from the primary plasma in the ionization chamber 102, ions created in the ionization chamber 102 have to flow out of the ionization chamber 102 to reach the cathode 302. Such an ion flow is largely impeded by the positive potential of the anode 304. If the potential of the anode 304 is high enough, low-energy ions cannot overcome this potential barrier to reach the negatively-charged cathode 302. However, the plasma ions created in the arc between the anode 304 and the ground element 306 can have an initial kinetic energy as high as the potential of the anode 304 (e.g., hundreds of eV). Ion sputtering yield is an increasing function of the ion energy K. Specifically, the maximum value of K in the vicinity of the electron gun 104 is given by: $K=e(V_e-V_a)$, where $V_a$ is the voltage of the anode 304, $V_e$ is the voltage of the cathode 302, and e is the electron charge. According to this relationship, K can be as large as the potential difference between the cathode 302 and the anode 304. Thus, to maximize the lifetime of the cathode 302, this difference can be minimized. In some embodiments, to keep the plasma or ion density near the cathode 302 low, the arc current of the plasma source mode is adjusted to be low as well. Such conditions correspond more closely to the electron impact mode than the plasma source mode, although both may be usefully employed without sacrificing cathode life. In general, the ion sputtering yield of refractory metals is minimal below about 100 eV and increases rapidly as ion energy increases. Therefore, in some embodiments, maintaining K below about 200V minimizes ion sputtering and is conducive to long life operation.

In some embodiments, the control circuit can operate the ion source 100 in either a "cluster" or "monomer" mode. As described above, the ion source 100 is capable of sustaining two separate regions of plasma—i) the secondary plasma 310 generated from an arc discharge between the anode 304 and the ground element 306 and ii) the primary plasma (not shown) generated from electron impact ionization of the gas within the ionization chamber 102. The ionization properties of these two plasma-forming mechanisms are different. For the secondary plasma 310, the arc discharge between the anode 304 and the ground element 306 can efficiently dissociate molecular gas species and create ions of the dissociated fragments (e.g., efficiently converting $BF_3$ gas to $B^+$, $BF^+$, $BF_2^+$ and $F^+$), in addition to negatively-charged species. In contrast, the plasma formed in the ionization chamber 102 by electron-impact ionization of the electron beam 308 tends to preserve the molecular species without substantial dissociation (e.g., converting $B_{10}H_{14}$ to $B_{10}H_x^+$ ions, where "x" denotes a range of hydride species, such as $B_{10}H_9^+$, $B_{10}H_{10}^+$, etc.). In view of these disparate ionization properties, the control circuit can operate the ion source 100 to at least partially tailor the ionization properties to a user's desired ion species. The control circuit can modify the "cracking pattern" of a particular gas species (i.e., the relative abundance of particular ions formed from the neutral gas species) to increase the abundance of the particular ion as desired for a given implantation process.

Specifically, in the monomer mode of operation, the control circuit can initiate either the ion pumping mode or the plasma source mode, where the secondary plasma is generated to produce a relative abundance of more dissociated ions. In contrast, in the cluster mode of operation, the control circuit can initiate the electron impact mode, where the primary plasma is dominant and the secondary plasma is weak to non-existent, to produce a relative abundance of parent ions. Thus, the monomer mode allows more positively charged ions to be propelled from the secondary plasma 310 of the electron gun 104 into the ionization chamber 102, but allows a weaker electron beam 308 or no electron beam to enter the ionization chamber 102. In contrast, the cluster mode of operation allows fewer positively charged ions, but a stronger electron beam 308 to enter the ionization chamber 102 from the electron gun 104.

As an example, consider the molecule $C_{14}H_{14}$. Ionization of this molecule produces both $C_{14}H_x^+$ and $C_7H_x^+$ ions due to symmetry in its bonding structure. Operating the ion source in the cluster mode increases the relative abundance of $C_{14}H_x^+$ ions, while operating the ion source in the monomer mode increases the relative abundance of $C_7H_x^+$ ions, since the parent molecule will be more readily cracked in the monomer mode. In some embodiments, monomer species of interest are obtained from gaseous- or liquid-phase materials such as $AsH_3$, $PH_3$, $BF_3$, $SiF_4$, Xe, Ar, $N_2$, $GeF_4$, $CO_2$, CO, $CH_3$, $SbF_5$, $P_4$, and $As_4$. In some embodiments, cluster species of interest are obtained from vaporized solid-feed materials, such as $B_{10}H_{14}$, $B_{18}H_{22}$, $C_{14}H_{14}$, and $C_{16}H_{10}$, and either gaseous- or liquid-phase materials, such as $C_6H_6$ and $C_7H_{16}$. These materials are useful as ionized implant species if the number of atoms of interest (B and C in these examples) can be largely preserved during ionization.

The control circuit can initiate one of the two modes by appropriately setting the operating voltages of the electron gun 104. As an example, to initiate the monomer mode, the control circuit can set i) the voltage of the emitter (Ve), such as the voltage of the cathode 302, to about −200 V, and ii) the voltage of the anode 304 (Va) to about 200 V. The monomer mode can also be initiated when Ve is set to approximately 0 V (i.e., plasma source mode), in which case there are substantially no ions created within the ionization chamber 102 by electron impact ionization. To initiate the cluster mode, the control circuit can set i) Ve to about −400 V, and Va to about 0 V.

Each ion type has its advantages. For example, for low-energy ion implantation doping or materials modification (e.g., amorphization implants), heavy molecular species containing multiple atoms of interest may be preferred, such as boron and carbon in the examples provided above. In contrast, for doping a silicon substrate to create transistor structures (e.g., sources and drains), monomer species, such as $B^+$, may be preferred.

Figure 4:
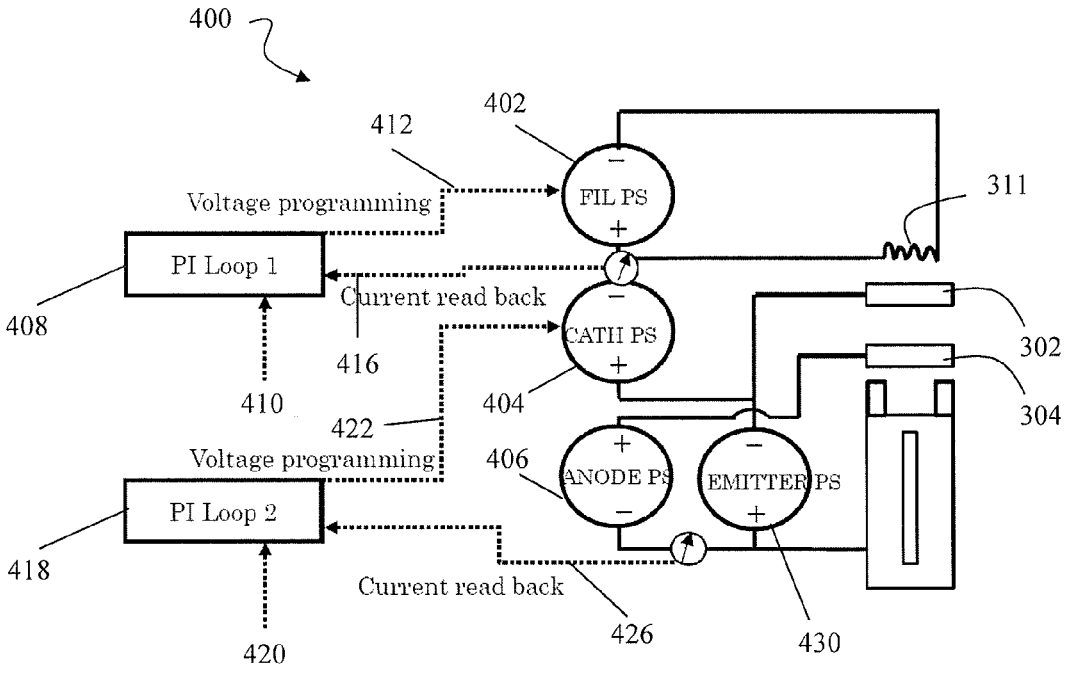
FIG. 4 shows a schematic diagram of an exemplary control system for the electron gun assembly of FIG. 3, according to embodiments of the present invention.

To control the operation of the electron gun 104 among the different modes of operation, the control circuit can regulate the current and/or voltage associated with each of the filament 311, the cathode 302, and the anode 304. FIG. 4 shows a schematic diagram of an exemplary control system 400 of the electron gun assembly 104 of FIG. 3, according to embodiments of the present invention. As illustrated, the control circuit 400 includes a filament power supply 402 for providing a voltage across the filament 311 (Vf) to regulate filament emission, a cathode power supply 404 (Vc) for biasing the filament 311 with respect to the cathode 302, an anode power supply 406 for providing a voltage to the anode 304 (Va), and an emitter power supply for providing a voltage of the emitter (Ve), such as the voltage of the cathode 302. In general, each of the power supplies 402, 404, 406 can operate in the controlled current mode, where each power supply sets an output voltage sufficient to meet a setpoint current. As shown, the control circuit 400 includes two closed-loop controllers: 1) a closed-loop controller 408 used to regulate current emission by the filament 311, and 2) a closed-loop controller 418 used to regulate arc current generated in the secondary plasma 310, which is the current sourced by the anode power supply 406.

At the beginning of a control operation, the control circuit 400 sets the cathode power supply 404 and the anode power supply 406 to their respective initial voltage values. The control circuit 400 also brings the filament 311 into emission using a filament warm-up utility that is available through an operator interface, for example. Once emission is attained, an operator of the control circuit 400 can initiate closed loop control via controllers 408 and 418.

The closed-loop controller 408 seeks to maintain a setpoint emission current value for the filament 311, which is the electron beam-heating current delivered to the cathode 302. The closed-loop controller 408 maintains this current value by adjusting the filament power supply 402 to regulate filament voltage, i.e., the voltage across the filament 311. Specifically, the controller 408 receives as input a setpoint filament emission current value 410, which is the current sourced by the cathode power supply 404. The setpoint current value 410 can be about 1.2 A, for example. In response, the controller 408 regulates the filament power supply 402 via output signal 412 such that the filament power supply 402 provides sufficient output voltage to allow the current leaving the filament power supply 402 to be close to the setpoint current value 410. The actual current leaving the filament power supply 402 is monitored and reported back to the controller 408 as a feedback signal 416. A difference between the actual current in the feedback signal 416 and the setpoint current 410 produces an error signal that can be conditioned by a proportional-integral-derivative (PID) filter of the controller 408. The controller 408 then sends an output signal 412 to the filament power supply 402 to minimize the difference.

The closed-loop controller 418 seeks to maintain a setpoint anode current by adjusting the current generated by the electron beam 308, since the anode current is proportional to the electron beam current. The closed-loop controller 418 maintains this setpoint current value by adjusting the electron beam heating of the cathode 302 by the filament 311 so as to regulate the amount of electrons emitted by the cathode 302. Specifically, the controller 418 receives as input a setpoint anode current 420. In response, the controller 418 regulates the cathode power supply 404 via an output signal 422 such that the cathode power supply 404 provides sufficient output voltage to allow the current at the anode power supply 406 to be close to the setpoint current 420. As described above, by adjusting the voltage of the cathode power supply 404, the level of electron heating of the cathode 302 is adjusted, and thus the current of the electron beam 308. Since the arc current of the anode 304 is fed by the electron beam 308, the anode current is therefore proportional to the current of the electron beam 308. In addition, the actual current leaving the anode power supply 406 is monitored and reported back to the controller 418 as a feedback signal 426. A difference between the actual current in the feedback signal 426 and the setpoint current 420 produces an error signal, which is conditioned by a PID filter of the controller 418. The controller 418 subsequently sends an output signal 422 to the cathode power supply 404 to minimize the difference.

In some embodiments, the kinetic energy of the electron beam 308 can be determined by the control circuit based on measuring the voltage of the emitter power supply 430. For example, the electron beam energy can be computed as the product of emitter supply voltage (Ve) and electron charge (e). The emitter power supply 430 can also source the electron beam current, which is equivalent to the current leaving the emitter power supply 430, and serve as the reference potential for the cathode power supply 404 which floats the filament power supply 402.

With continued reference to FIG. 3, the ground element 306 of the electron gun 104 can be configured to decelerate the electron beam 308 by reducing the final energy of the electron beam 308 before it enters the ionization chamber 102. Specifically, the ground element 306 can include one or more lenses, such as two lenses, that are shaped according to a reverse-Pierce geometry to act as deceleration lens. As an example, the electron beam 308 may approach the ground element 306 at 500 eV, and decelerate to 100 eV after passing the ground element 306. As a result, a lower-energy electron current is introduced to the ionization chamber 102 than otherwise possible. In addition, an external, substantially uniform magnetic field 320 can be applied to confine the electron beam 308 to helical trajectories. The magnetic field 320 can also confine the primary plasma (not shown) and the secondary plasma 310 to inside of the ion source 100. Details regarding the magnetic field 320 are described below with reference to FIGS. 5-7.

At least one electron gun 104 of FIG. 3 can be used to introduce an electron beam and/or ions into the ionization chamber 102 via the aperture 312. The aperture 312 can allow transport of a gas from the ionization chamber 102 to the electron gun 104, from which the secondary plasma 310 in the electron gun 104 can be formed during the ion pumping mode. In some embodiments, two electron guns are used, each positioned on an opposite side of the ionization chamber 102, as shown in FIG. 1. The electron beam introduced by each of the pair of electron guns 104 is adapted to travel in the longitudinal direction 118 inside of the ionization chamber 102. The electron beam from each electron gun 104 ionizes the gas in the ionization chamber 102 to produce ions in the ionization chamber 102. Additional ions can be introduced by the electron guns 104 into the ionization chamber 102 if the ion pumping mode is activated.

In one aspect, one or more components of the ion source 100 are constructed from graphite to minimize certain harmful effects from, for example, high operating temperatures, erosion by ion sputtering, and reactions with fluorinated compounds. The use of graphite also limits the production of harmful metallic components, such as refractory metals and transition metals, in the extracted ion beam 116. In some examples, the anode 304 and the ground element 306 of the electron guns 104 are made of graphite. In addition, one or more electrodes used to extract ions from the ionization chamber 102 can be made of graphite, including the plasma electrode 106 and the puller electrode 108. Furthermore, the ionization chamber 102, which can be made of aluminum, can be lined with graphite.

Figure 5:
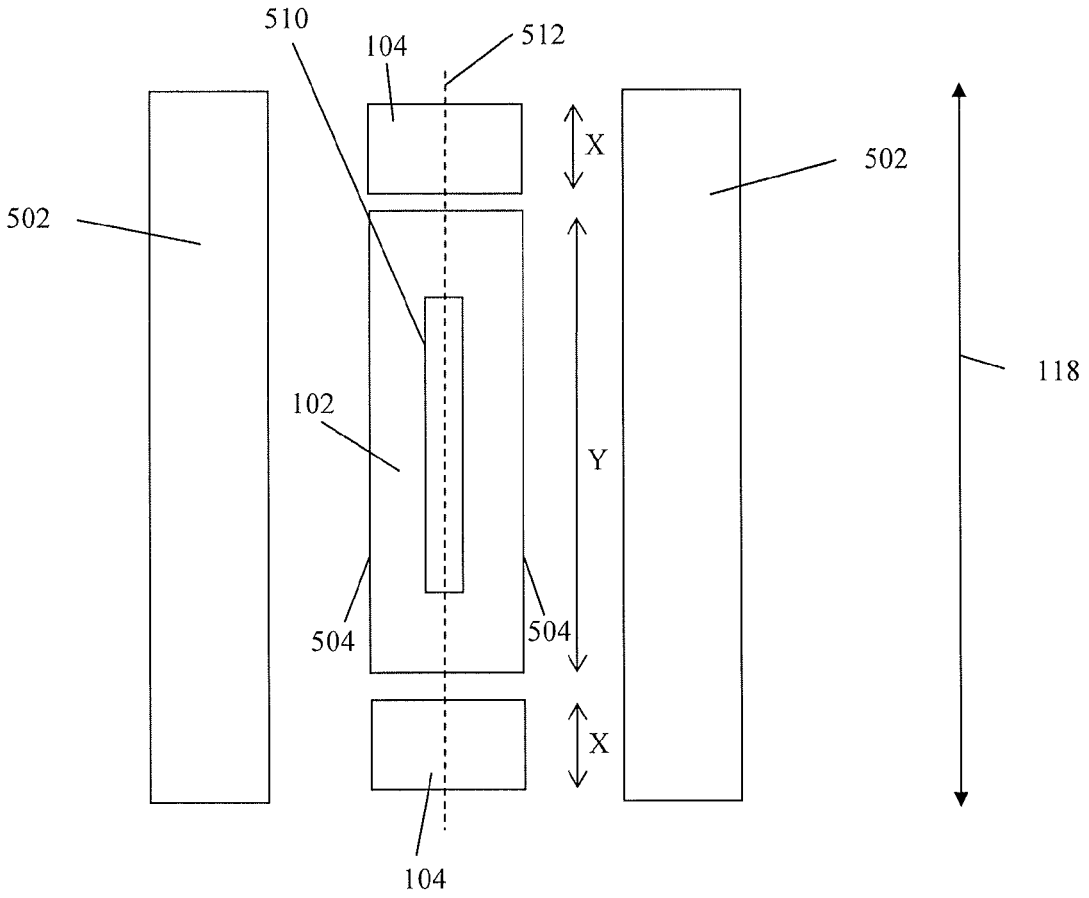
FIG. 5 shows a schematic diagram of an exemplary ion source including a pair of magnetic field sources, according to embodiments of the present invention.

In another aspect, the ion source 100 can include one or more magnetic field sources positioned adjacent to the ionization chamber 102 and/or the electron guns 104 to produce an external magnetic field that confines the electron beam generated by each of the electron guns 104 to the inside of the electron guns 104 and the ionization chamber 102. The magnetic field produced by the magnetic field sources can also enable the extracted ion beam 116 to achieve a more uniform ion density distribution. FIG. 5 shows a schematic diagram of an exemplary ion source including a pair of magnetic field sources, according to embodiments of the present invention. As illustrated, an external magnetic field can be provided by the pair of magnetic field sources 502 positioned on each side of the ionization chamber 102 parallel to the path of the electron beam 308, i.e., parallel to the longitudinal axis 118 of the ionization chamber 102. The pair of magnetic field sources 502 can be aligned with and adjacent to external surfaces of two opposing chamber walls 504, respectively, where the opposing chamber walls are parallel to the longitudinal axis 118. In some embodiments, at least a portion of the surface of the ionization chamber 102, except for the opposing chamber walls 504 and the sides opposing to the electron guns 104, can form the extraction aperture. FIG. 5 shows an exemplary placement of an extraction aperture 510 on a surface of the ionization chamber 102. The two magnetic field sources 502 can be symmetrical about the plane including the center axis 512 of the ionization chamber 102 parallel to the longitudinal axis 118. Each magnetic field source 502 can comprise at least one solenoid.

One of the opposing chamber walls can define the extraction aperture. The two magnetic field sources 502 can be symmetrical about the longitudinal axis 118. Each magnetic field source 502 can comprise at least one solenoid.

The longitudinal length of each magnetic field source 502 is at least as long as the longitudinal length of the ionization chamber 102. In some embodiments, the longitudinal length of each magnetic field source 502 is at least as long as the lengths of the two electron guns 104 plus that of the ionization chamber 102. For example, the longitudinal length of each magnetic field source 502 can be about 500 mm, 600 mm, 700 mm or 800 mm. The magnetic field sources 502 can substantially span the ionization chamber's extraction aperture, from which ions are extracted. The magnetic field sources 502 are adapted to confine the electron beam 308 over a long path length. The path length is given by (2X+Y) as indicated in FIG. 5, where X is the extent of the electron gun 104, and Y is the extent of the ionization chamber 102 (Y is also roughly the length of the ion extraction aperture, and the desired length of the extracted ribbon ion beam 116).

Figure 6:
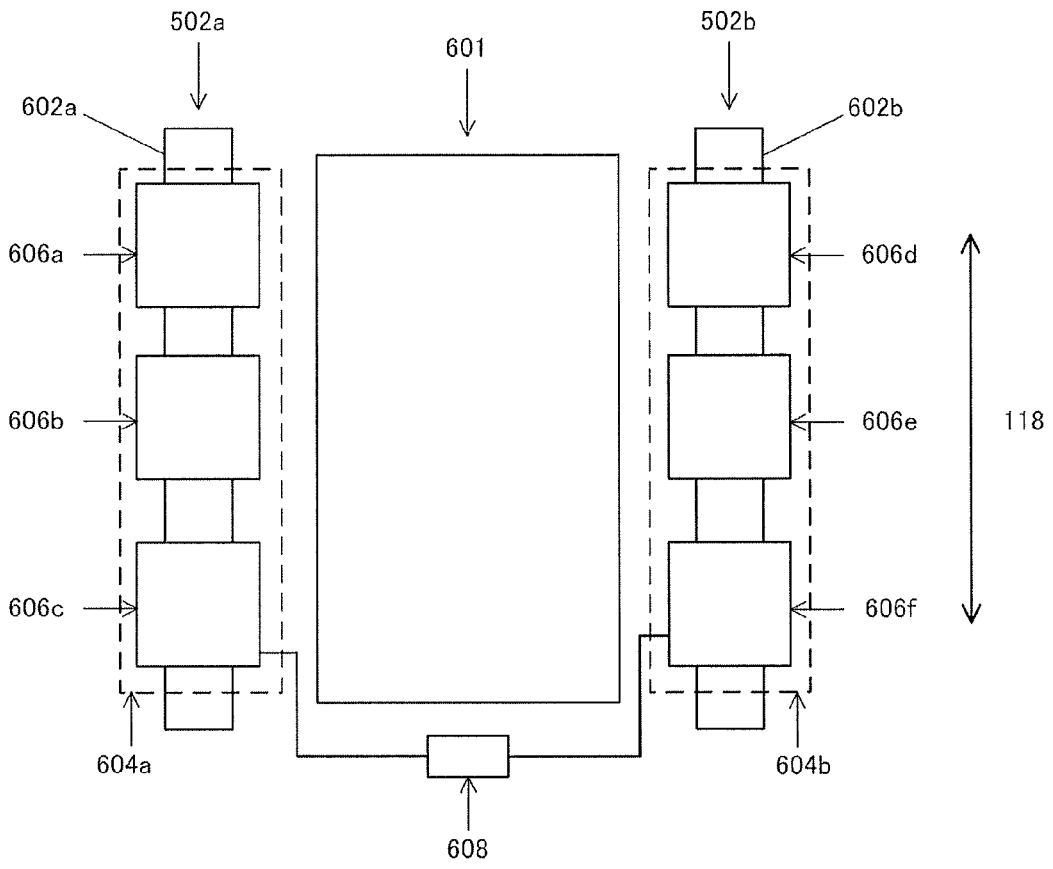
FIG. 6 shows a schematic diagram of an exemplary configuration of the magnetic field sources of FIG. 5, according to embodiments of the present invention.

FIG. 6 shows a schematic diagram of an exemplary configuration of the magnetic field sources 502 of FIG. 5, according to embodiments of the present invention. As shown, each magnetic field source 502 includes i) a magnetic core 602, and ii) an electromagnetic coil assembly 604 generally wound around the core 602. The ion source structure 601, including the ionization chamber 102 and the electron guns 104, is immersed in an axial magnetic field produced by the electromagnetic coil assembly 604. In some embodiments, neither of the pair of magnetic field sources 502 is connected to a magnetic yoke, such that the magnetic flux generated by the magnetic field sources 502 dissipates into space and returns far away from the ion source structure 601. This configuration produces a magnetic flux in the ion source structure 601 that has been found to introduce improved uniformity in the ion density profile of the extracted ion beam 116 in the longitudinal direction 118. In addition, the magnetic flux in the ion source structure 601 may be oriented in the longitudinal direction 118. In some embodiments, the two magnetic field sources 502 are physically distant from each other and their magnetic cores 602 are electrically isolated from each other. That is, there is no electrical connection between the pair of magnetic cores 602.

Each coil assembly 604 can comprise multiple coil segments 606 distributed along the longitudinal axis 118 and independently controlled by a control circuit 608. Specifically, the control circuit 608 can supply a different voltage to each of the coil segments. As an example, the coil assembly 604*a* can comprise three coil segments 606*a-c* that generate independent, partially overlapping magnetic fields over the top, middle and bottom sections of the ion source structure 601. The resulting magnetic field can provide confinement of the electron beam 308 generated by each of the electron guns 104, and thus create a well-defined plasma column along the longitudinal axis 118.

The magnetic flux density generated by each of the coil segments 606 can be independently adjusted to correct for non-uniformities in the ion density profile of the extracted ion beam 116. As an example, for coil assembly 604*a*, the center segment 606*b* can have half of the current as the current supplied to the end segments 606*a*, 606*c*. In some embodiments, corresponding pairs of coil segments 606 for the pair of magnetic field sources 502 are supplied with the same current. For instance, coils 606*a* and 606*d* can have the same current, coils 606*b* and 606*e* can have the same current, and coils 606*c* and 606*f* can have the same current. In some embodiments, each of the coil segments 606*a-f* is supplied with a different current. In some embodiments, multiple control circuits are used to control one or more of the coil segments 606. Even though FIG. 6 shows that each coil assembly 604 has three coil segments 606, each coil assembly 604 can have more or fewer segments. In addition, the pair of coil assemblies 604 do not need to have the same number of coil segments 606. The number and arrangement of coil segments 606 for each coil assembly 604 can be suitably configured to achieve a specific ion density distribution profile in the extracted ion beam 116.

Figure 7:
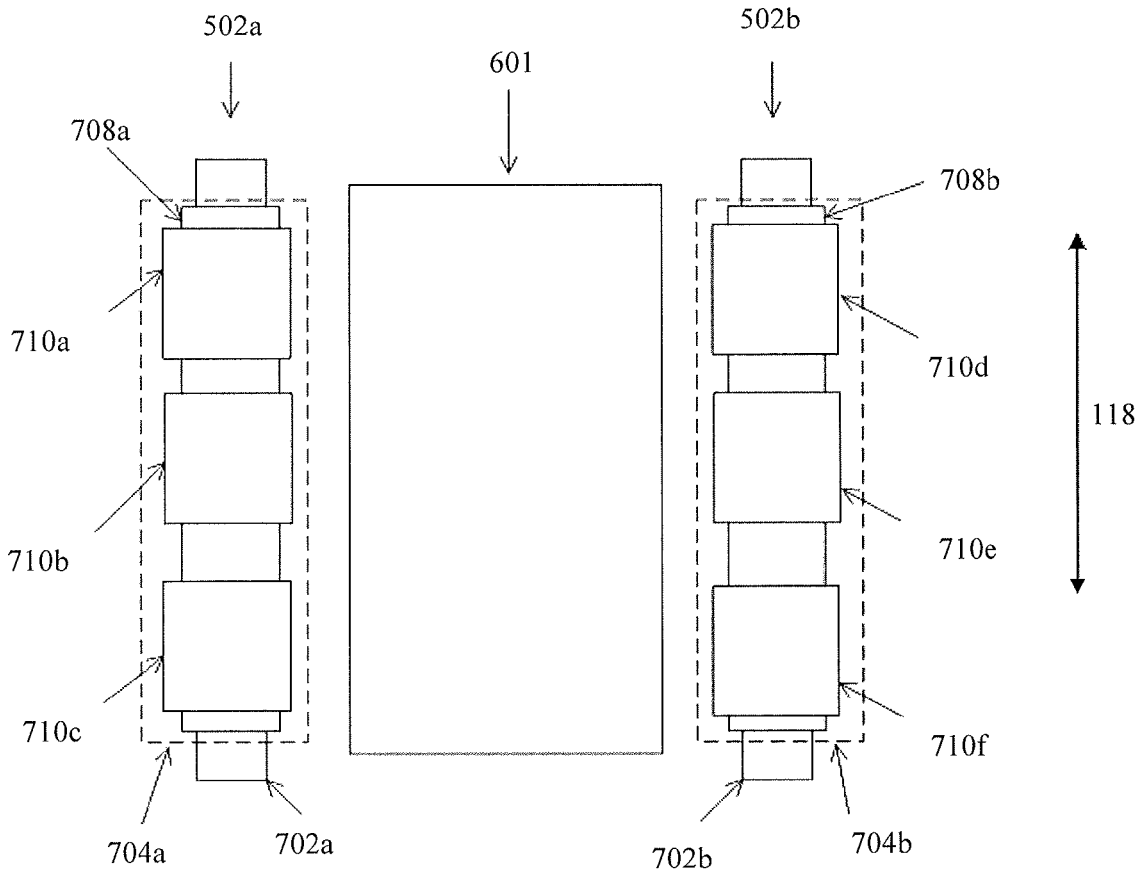
FIG. 7 shows a schematic diagram of another exemplary configuration of the magnetic field sources of FIG. 5, according to embodiments of the present invention.

FIG. 7 shows a schematic diagram of another exemplary configuration of the magnetic field sources 502 of FIG. 5, according to embodiments of the present invention. As illustrated, the coil assembly 704 of each magnetic field source 502 can include 1) a main coil segment 708 substantially wound around the corresponding magnetic core 702, and 2) multiple sub coil segments 710 wound around the main coil segment 708. Each of the main coil segment 708 and the sub coil segments 710 of each coil assembly 704 is independently controlled by at least one control circuit (not shown). This arrangement provides the operator with a greater flexibility in adjusting the magnetic flux generated by the magnetic field sources 502, such that the resulting ion beam 116 has a desired ion density distribution in the longitudinal direction 118. For example, the main coil segments 708 can be used to provide rough control of the magnetic field in the ion source structure 601 while the sub coil segments 710 can be used to fine tune the magnetic field. In some embodiments, the longitudinal length of each main coil segment 708 is at least the length of the ionization chamber 102 while the length of each sub coil segment 710 is less than the length of the main coil segment 708.

Figure 8:
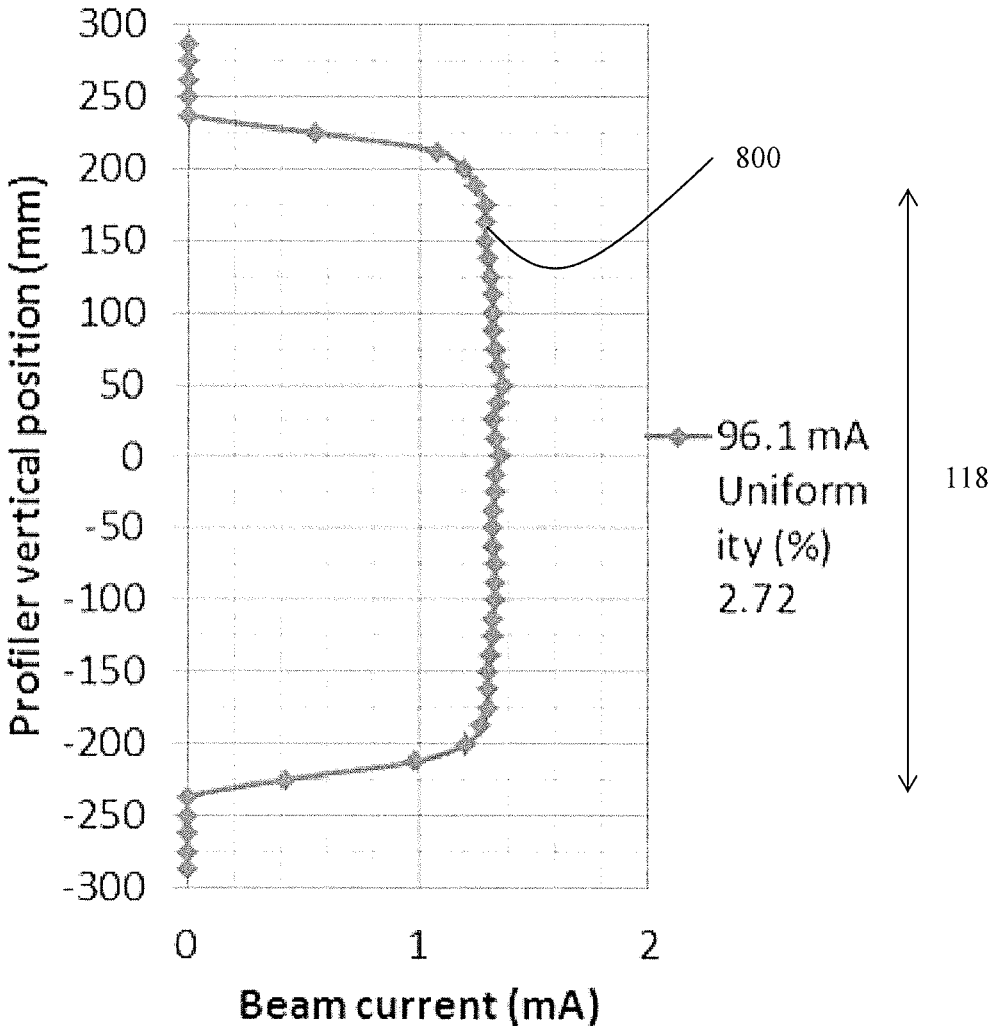
FIG. 8 shows a diagram of an exemplary ion density profile of an ion beam generated by the ion source of the present invention.

FIG. 8 shows a diagram of an exemplary ion density profile of an ion beam generated by the ion source 100. The profile shows the current density along the longitudinal axis 118. As illustrated, the total ion beam current 800 from the exemplary ion beam is about 96.1 mA and the current density is substantially uniform over a 400 mm length to within plus or minus about 2.72% along the longitudinal axis 118.

Figure 9:
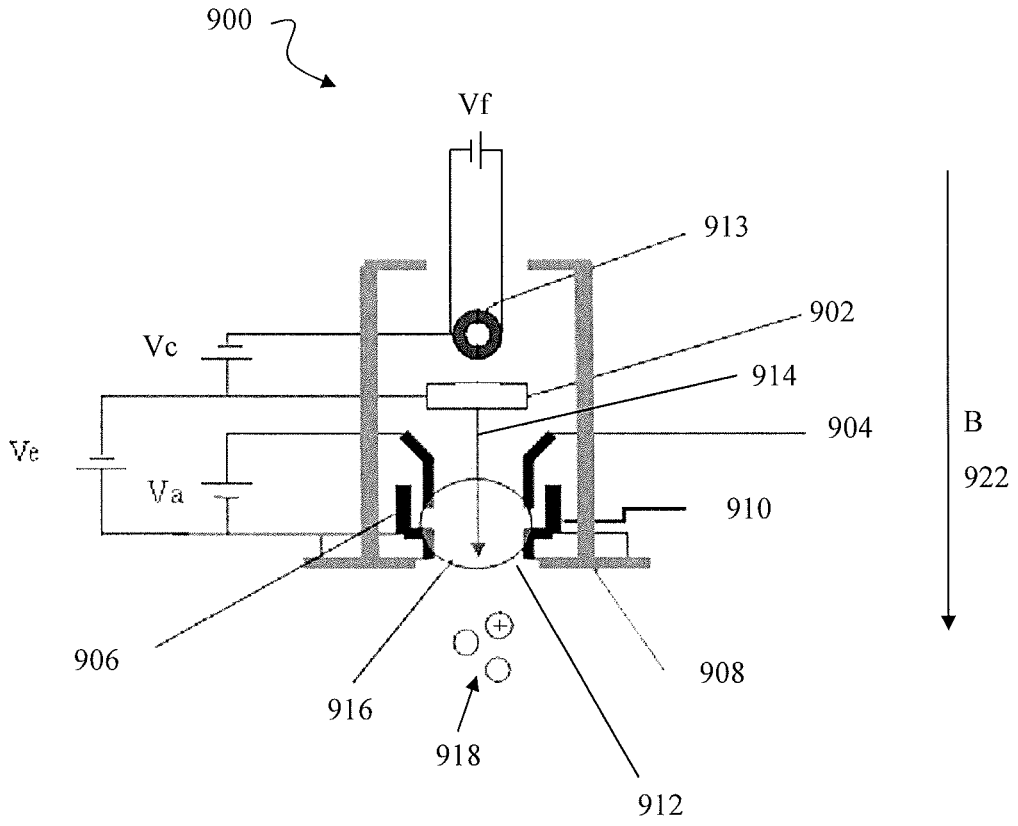
FIG. 9 shows a schematic diagram of another exemplary ion source, according to embodiments of the present invention.

FIG. 9 shows a schematic diagram of another exemplary ion source, according to embodiments of the present invention. The ion source 900 includes a cathode 902, an anode 904, a ground element 906, a magnetic field source assembly 908, and a gas feed 910. The cathode 902 can be substantially similar to the cathode 302 of FIG. 3, which can be heated directly or indirectly. If the cathode 902 is heated indirectly, a filament 913 can be used to perform the indirect heating. The cathode 902 is adapted to thermionically emit electrons, leading to the formation of an energetic electron beam 914 at the anode 904, which is held at a positive potential in relation to the cathode 902. In addition, similar to the electron gun arrangement 104 of FIG. 3, plasma 916 can be formed in the ion source 900 between the anode 904 and the ground element 906. The plasma 916 is created from the ionization of a gas that is introduced directly into the ion source 900 via the gas feed 910 through the ground element 906. The electron beam 914 can sustain the plasma 916 for an extended period of time. The plasma 916 is adapted to generate positively charged ions 918 that can be extracted at the aperture 912 by an extraction system (not shown) and transported to a substrate for implantation. An ionization chamber is not needed in the ion source 900. Therefore, the ion source 900 is relatively compact in design and deployment.

In some embodiments, at least one control circuit (not shown) can be used to regulate the current and/or voltage associated with each of the filament 912, the cathode 902, and the anode 904 to control the operation of the ion source 900. The control circuit can cause the ion source 900 to operate in one of the ion pumping mode or the plasma source mode, as described above. The control circuit can also adjust the flow rate of the gas feed 910 to regulate the quality of the extracted ion beam (not shown).

Optionally, the ion source 900 can include the magnetic field source assembly 908 that produces an external magnetic field 922 to confine the electron beam 914 to inside of the ion source 900. As illustrated, the magnetic field source assembly 908 comprises a yoke assembly coupled to permanent magnets to generate a strong, localized magnetic field 922, which can be parallel to the direction of the electron beam 914. Alternatively, an electromagnetic coil assembly, wound around a yoke structure, can be used. Thus, the incorporation of a large external magnet coil that is typical of many ion source systems is not needed. Such a magnetic field source assembly 908 terminates the magnetic field close to the ion source 900 so that it does not penetrate far into the extraction region of the ions. This allows ions to be extracted from a substantially field-free volume.

The ion source design of FIG. 9 has many advantages. For example, by localizing the ionization region of the ion source 900 within the emitter assembly (i.e., without using a large ionization chamber), the size of the ion source 900 is significantly reduced. In addition, by introducing a gas to the plasma 916 at its point of use, rather than into a large ionization chamber, gas efficiency is substantially increased and it contributes to the compact, modular design of the ion source 900. Furthermore, producing local magnetic confinement of the plasma 916 with appropriate field clamps enable ion current to be extracted from a substantially field-free zone.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed:

1. An ion source comprising:

at least one electron gun, the electron gun including:

an electron source for generating a beam of electrons;

an inlet for receiving a gas;

a plasma region defined by at least an anode and a ground element, the plasma region adapted to form a plasma from the gas received via the inlet by electron impact, wherein the plasma is sustained by at least a portion of the beam of electrons; and an outlet for delivering at least one of (i) ions generated by the plasma or (ii) at least a portion of the beam of electrons.

2. The ion source of claim 1, further comprising a control circuit for adjusting a voltage of the anode to substantially turn off the plasma in the plasma region, wherein the outlet is configured to deliver the at least a portion of the beam of electrons without the ions.

3. The ion source of claim 1, wherein the ground element comprises at least one lens for decelerating the at least a portion of the beam of electrons prior to the beam of electrons leaving the at least one electron gun via the outlet.

4. The ion source of claim 1, wherein the inlet and the outlet of the at least one electron gun comprise a single aperture.

5. The ion source of claim 4, further comprising an ionization chamber having two ends disposed along a longitudinal axis, wherein one of the two ends is coupled to the aperture of the at least one electron gun for (i) supplying the gas from the ionization chamber to the electron gun and (ii) receiving at least one of the ions or the at last a portion of the beam of electrons from the electron gun to the ionization chamber.

6. The ion source of claim 5, further comprising a second electron gun substantially similar to the at least one electron gun, wherein each electron gun is positioned at one of the two ends of the ionization chamber for delivering at least one of the ions or the beam of electrons to the ionization chamber.

7. The ion source of claim 5, further comprising at least one extraction electrode at an exit aperture of the ionization chamber for extracting ions from the ionization chamber.

8. The ion source of claim 7, wherein the ionization chamber or the at least one extraction electrode, or a combination thereof, is made of graphite.

9. The ion source of claim 7, further comprising four extraction electrodes, wherein at least two of the extraction electrodes are movable relative to the ionization chamber.

10. The ion source of claim 1, wherein the electron source comprises: (i) a filament and (ii) a cathode indirectly heated by a current thermionically emitted by the filament to generate the beam of electrons.

11. The ion source of claim 10, further comprising a first closed loop control circuit for adjusting the voltage across the filament to maintain the emission current of the filament to the cathode at or near a reference current value.

12. The ion source of claim 10, further comprising a second closed loop control circuit for adjusting the potential between the filament and the cathode to maintain the current of the anode at or near a reference current value.

13. An ion source comprising:

an ionization chamber including i) two internal apertures at two opposite ends along a longitudinal axis extending through the ionization chamber and ii) an exit aperture along a side wall of the ionization chamber for extracting ions from the ionization chamber; and two electron guns each positioned relative to one of the two internal apertures, each electron gun including:

an electron source for generating a beam of electrons;

an inlet for receiving a gas from the ionization chamber; and a plasma region for generating a plasma from the gas by electron impact, the plasma region being sustained by at least a portion of the beam of electrons;

wherein each electron gun delivers to the ionization chamber at least one of (i) ions formed by the plasma of the corresponding electron gun or (ii) at least a portion of the beam of electrons generated by the corresponding electron gun.

14. The ion source of claim 13, further comprising a plurality of gas inlets along a sidewall of the ionization chamber for delivering a gas into the ionization chamber for ionization by the at least a portion of the beam of electrons supplied by each of the electron guns.

15. A method for operating an ion source, the method comprising:

generating a beam of electrons by an electron source of an electron gun;

receiving a gas at an inlet of the electron gun;

forming a plasma in a plasma region of the electron gun from the gas and the beam of electrons by electron impact; and providing at least one of (i) ions formed by the plasma or (ii) at least a portion of the beam of electrons via an outlet of the electron gun to an ionization chamber.

16. The method of claim 15, further comprising:

adjusting a voltage of the anode to substantially eliminate the plasma in the plasma region; and providing only the at least a portion of the beam of electrons to the ionization chamber.

17. The method of claim 15, further comprising indirectly heating a cathode of the electron source to generate the beam of electrons.

18. The method of claim 15, further comprising:

providing a gas to the ionization chamber via a plurality of gas inlets of the ionization chamber; and generating a second plasma in the ionization chamber based on the at least a portion of the beam of electrons and the gas.

19. An electron gun comprising:

an electron source for generating a beam of electrons;

an inlet for receiving a gas;

a plasma region defined by at least an anode and a ground element, the plasma region adapted to form a plasma based on the gas received by electron impact, wherein the plasma is sustained by at least a portion of the beam of electrons; and an outlet for delivering at least one of (i) ions formed by the plasma or (ii) at least a portion of the beam of electrons.

20. The electron gun of claim 19, further comprising a control circuit for adjusting a voltage of the anode to substantially turn off the plasma in the plasma region, wherein the outlet is configured to deliver the at least a portion of the beam of electrons without the ions.

21. An ion source comprising:

a gas source for supplying a gas;

at least one electron gun, the electron gun including:

an emitter for generating a beam of electrons;

a plasma region defined by at least an anode and a ground element, the plasma region adapted to form a secondary plasma from the gas by electron impact, wherein the secondary plasma is sustained by at least a portion of the beam of electrons; and an ionization chamber for receiving from the at least one electron gun at least one of (i) a first set of ions generated by the secondary plasma or (ii) at least a portion of the beam of electrons, the ionization chamber adapted to form a primary plasma from the gas and the at least a portion of the beam of electrons, wherein the primary plasma generates a second set of ions; and a control circuit for modulating at least one of a voltage of the anode or a voltage of the emitter to produce desired quantities of the first set of ions and the second set of ions, wherein the first set of ions includes more dissociated ions than the second set of ions.

22. The ion source of claim 21, wherein the control circuit is configured to operate in a monomer mode by producing more of the first set of ions than the second set of ions.

23. The ion source of claim 21, wherein the control circuit is configured to operate in a cluster mode by producing more of the second set of ions than the first set of ions.

* * * * *